US005493778A

United States Patent [19]

Ichiyanagi

[11] Patent Number: 5,493,778

[45] Date of Patent: Feb. 27, 1996

[54] RAZOR UNIT

[75] Inventor: Masao Ichiyanagi, Seki, Japan

[73] Assignee: Feather Safety Razor Co., Ltd., Osaka, Japan

[21] Appl. No.: 301,796

[22] Filed: Sep. 7, 1994

[30] Foreign Application Priority Data

Nov. 29, 1993 [JP] Japan ..... 5-298622

[51] Int. Cl.[6] ..... B26B 19/40

[52] U.S. Cl. ..... 30/41; 30/50

[58] Field of Search ..... 30/41, 50, 32

[56] References Cited

U.S. PATENT DOCUMENTS 4,624,051 11/1986 Apprille, Jr. et al. ..... 30/50
4,697,342 10/1987 Ferraro ..... 30/41
5,056,222 10/1991 Miller et al. ..... 30/41
5,313,706 5/1994 Motta et al. ..... 30/50

FOREIGN PATENT DOCUMENTS 2-191486 7/1990 Japan .
2-56114 11/1990 Japan .

*Primary Examiner*—Hwei-Siu Payer
*Attorney, Agent, or Firm*—Nawrocki, Rooney & Sivertson

[57] ABSTRACT

There is provided a razor unit having a solid lubricant material which is dampened and swelled, when soaked in the water, for reducing rubbing of the razor unit on the user's skin. The razor unit has a cap member and a pair of blades protruded from the cap member. The cap member has a recess in the inner surface and a notch in the outer surface. The notch communicates with the recess. The solid lubricant material has a smooth surface and is accommodated in the recess. The solid lubricant material is retracted in the outer surface of the cap member, and protrudable from the outer surface through the notch when the material is soaked in the water.

7 Claims, 4 Drawing Sheets

RAZOR UNIT

This application claims a priority of Japanese Patent Application No. 5-298622 which was filed with the Japanese Patent Office on Nov. 29, 1993.

BACKGROUND OF THE INVENTION

1. Field of the Invention

The present invention relates to a razor unit, more particularly to a razor unit having a solid lubricant material attached thereto to improve the shaving quality of the razor when razor is in use.

2. Description of the Related Art

There is a type of razor unit having a solid lubricant material (hereinafter called a "smoother") which contacts the user's skin. The smoother protects the user's skin by reducing rubbing of the unit base with the user's skin. Japanese Examined Patent Publication No. 2-56114 discloses the above razor unit. As shown in FIGS. 4 and 5, this razor unit includes a base assembly 32 having a channel 34 therein. The channel 34 opens upward through three elongated windows 33 arranged in the longitudinal direction of the channel 34. In the channel 34 is accommodated a smoother 35 having three portions 35*a* each of which projecting out through the associated window 33. The smoother is made of a material being expandable when soaked in the water. Accordingly, the water-soaked smoother reduces rubbing of the base 32 with the user's skin for realizing a smooth shaving.

However, the portions 35*a* extruding from the upper surface of the base tend to contact the outside articles when the unit is put on the washstand or the like. This oftentimes damages the uncovered portions 35*a*, resulting in the less swelling effect and short life of the smoother 35.

Furthermore, the smoother 35 is to be fitted in the base 32 so that the portions 35*a* are exposed from the windows 33, when the smoother 35 is applied to the base 32. More specifically, in the narrow channel 34, the smoother 35 should be manipulated with its portions 35*a* directed to the windows 33. This makes the assembling process extremely troublesome.

Additionally, a further difficulty has been pointed out during the manufacturing process of the conventional smoother 35. The smoother 35 is formed in an extruding process. For forming the smoother 35, the synthetic resin such as a polyethylene oxide or polyvinyl is used. The resin extruded from a mold has a plate shape, which is then sliced very thinly in accordance with the depth of the channel 34. This work requires a high precision. Accordingly, it is very difficult even for the skillful workers to carry out the slicing work with high accuracy and precision.

SUMMARY OF THE INVENTION

It is therefore a primary object of the present invention to provide a razor unit having an excellent durability and dampening and swelling efficiency It is another object of the present invention to provide a razor unit in which smoother is easily fitted to a razor unit.

It is a further object of the present invention to provide a razor unit having a smoother which is manufactured in the easy process.

To achieve the above objects, there is provided a razor unit having a solid lubricant material which is dampened and swelled, when soaked in the water, for reducing rubbing of the razor unit on the user's skin. The razor unit has a cap member having an inner surface and an outer surface, and a blade protruding from the cap member. The cap member has a recess in the inner surface of and a notch in the outer surface. The notch communicates with the recess. The solid lubricant material has a smooth surface and is accommodated in the recess. The solid lubricant material is retracted in the outer surface of the cap member, and protrudable from the outer surface through the notch when the solid lubricant material is soaked in the water.

BRIEF DESCRIPTION OF THE DRAWINGS

The features of the present invention that are believed to be novel are set forth with particularity in the appended claims. The invention, together with objects and advantages thereof, may best understood by reference to the following description of the preferred embodiments together with the accompanying drawings, in which:

DETAILED DESCRIPTION OF THE PREFERRED EMBODIMENT

The preferred embodiment of the present invention will now be described in greater detail, with reference to FIGS. 1 through 3.

Figure 1:
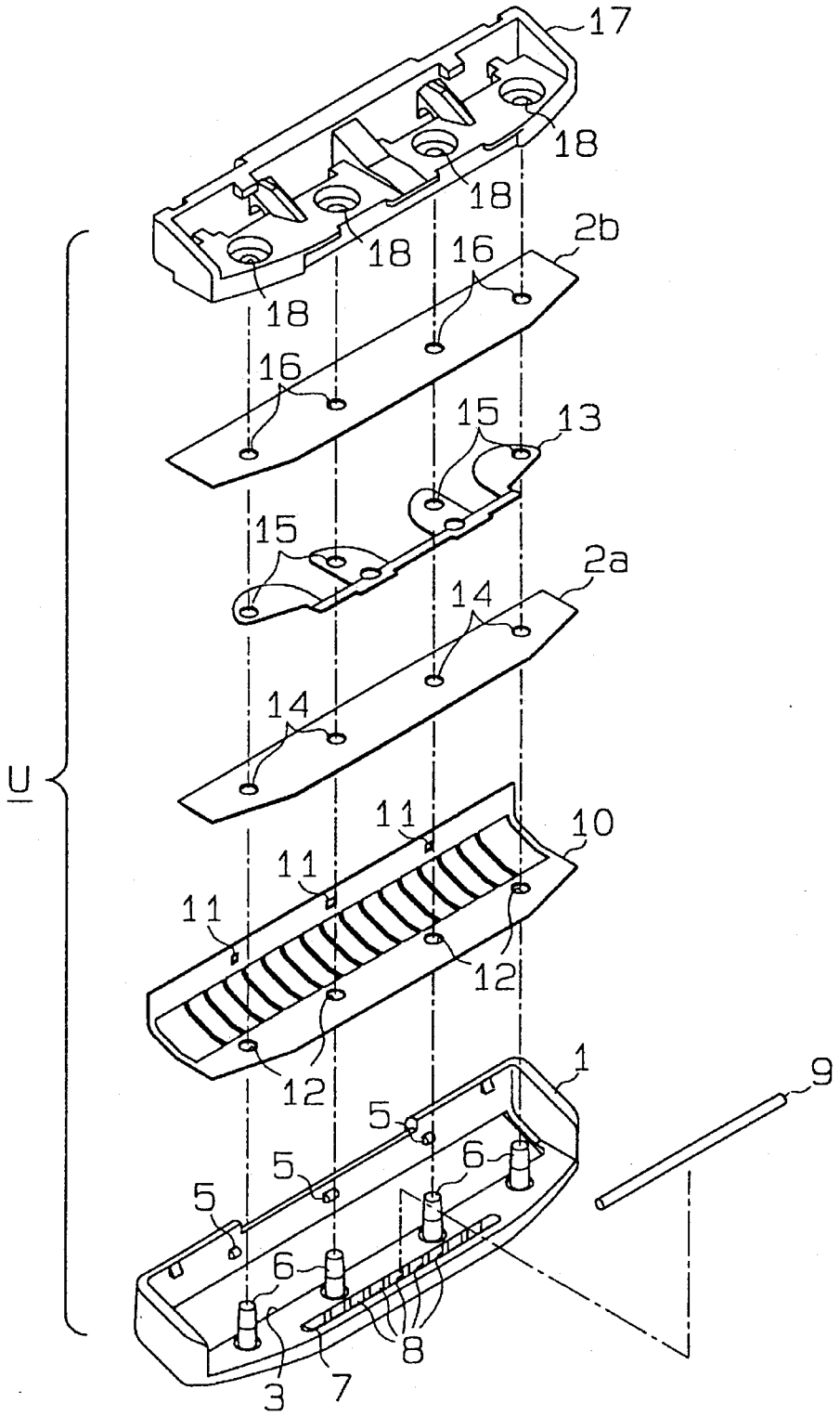
FIG. 1 is an exploded perspective view illustrating a razor unit according to the present invention.
Figure 2:
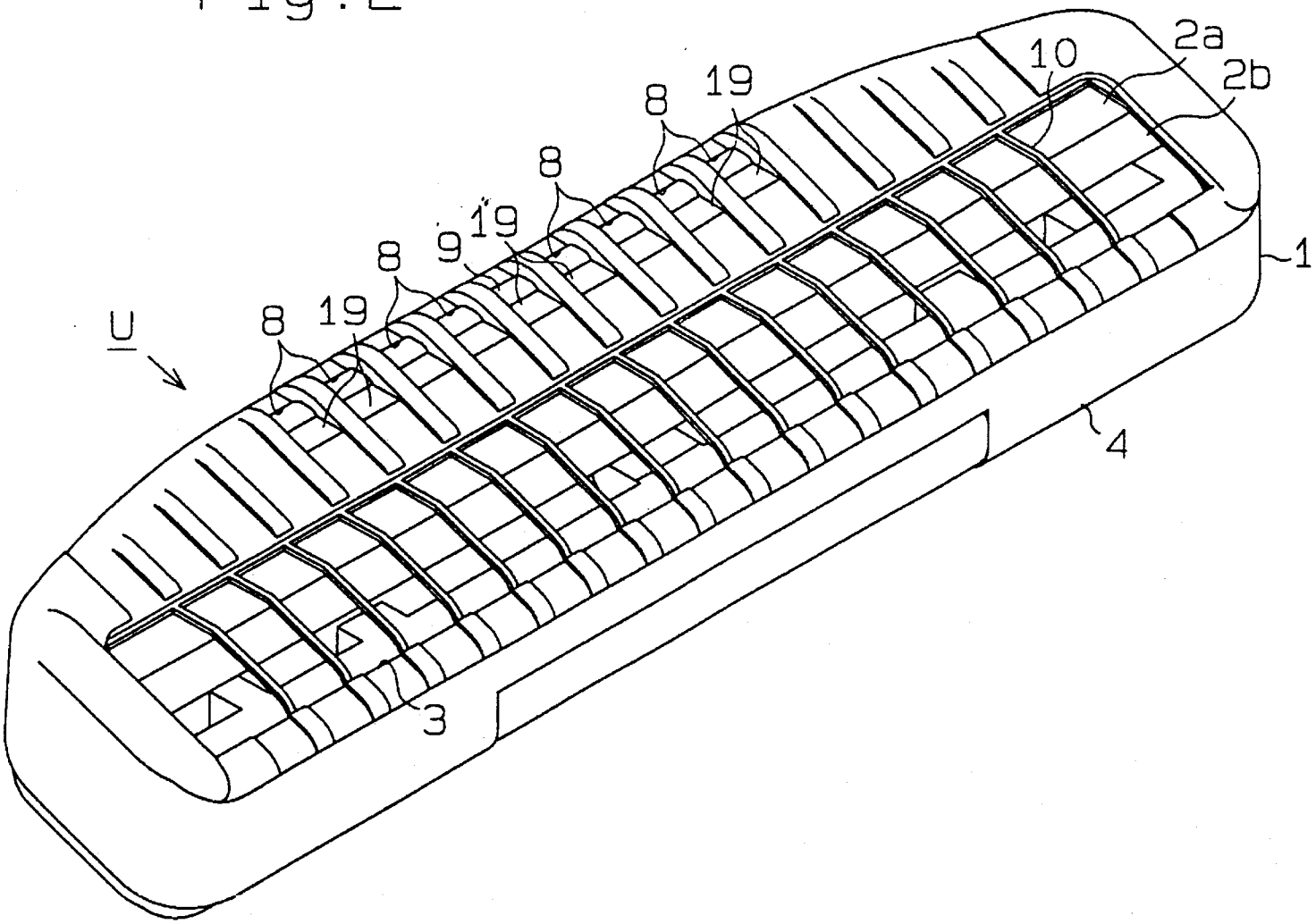
FIG. 2 is a perspective view illustrating the assembled razor unit.
Figure 3:
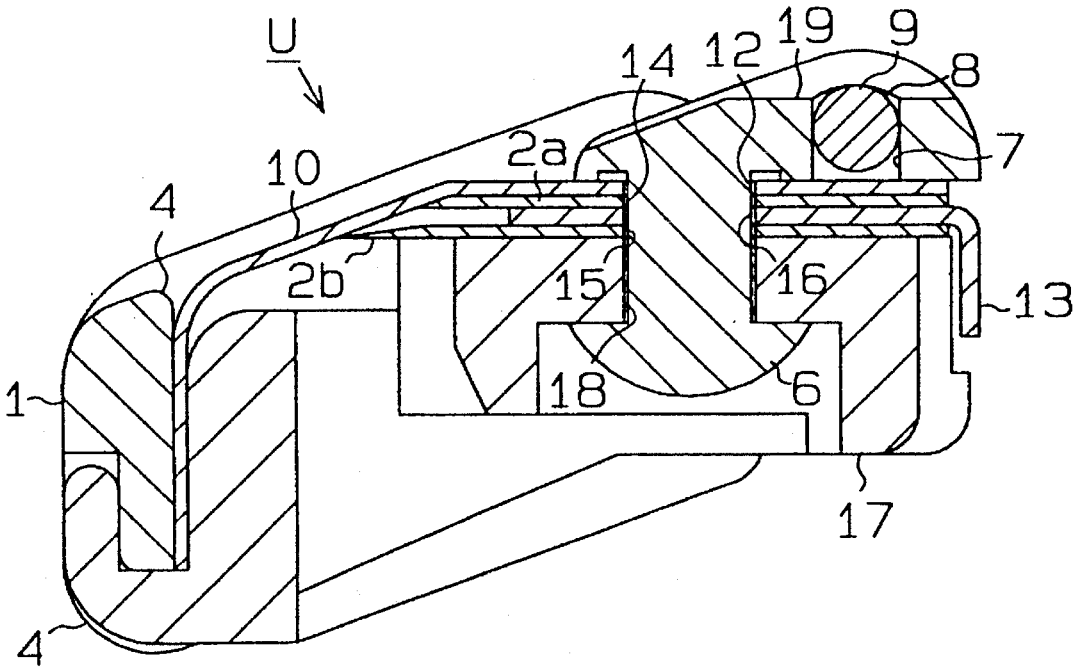
FIG. 3 is a cross sectional view of the razor unit.
Figure 5:
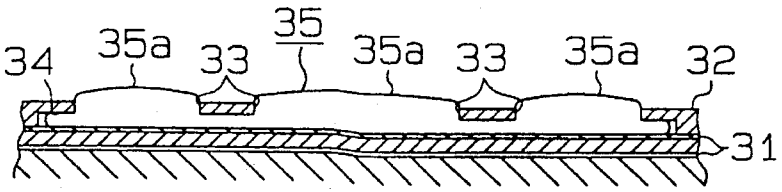
Fig.5 (PRIOR ART)
FIG. 5 is a cross sectional view illustrating the conventional razor unit.
Figure 4:
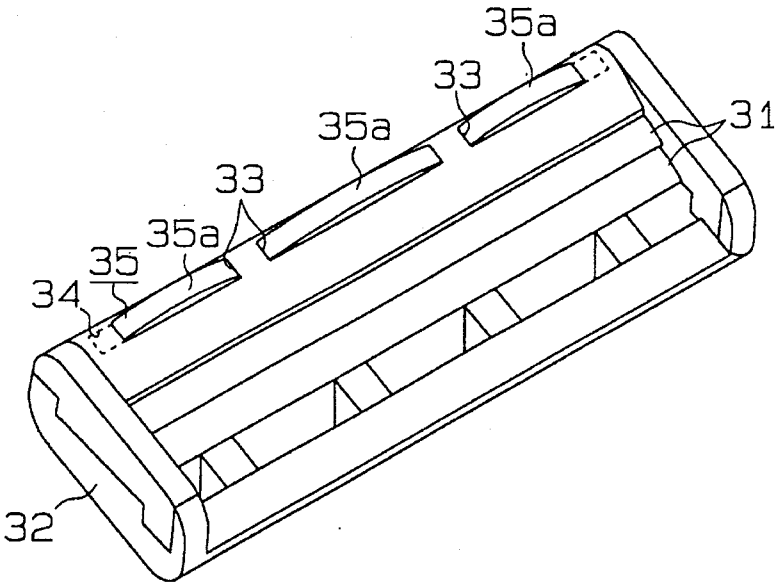
Fig.4 (PRIOR ART)
FIG. 4 is a perspective view illustrating a conventional razor unit.

In FIGS. 1 and 2, a razor unit U has a cap member 1 made of synthetic resin. The cap member 1 has an opening 3 for exposing two blades 2*a* and 2*b*. The cap member 1 has a front portion including a unit guide 4 for leading the unit U which contacts and moves along the user's skin when the unit U is in use.

The inside construction of the cap member 1 is hereinafter explained in detail. As shown in FIG. 1, the guide 4 has engaging projections 5 laterally arranged on an inner wall of the guide 4. An elongated recess 7 is extending along the opening 3. Four pins 6 are provided between the recess 7 and the opening 3. A plurality of through holes 8 are formed with a bottom surface of the recess 7. As shown in FIG. 2, in association with the through holes 8, a plurality of notches 19 are formed with an upper surface of the cap member 1. Each notch 19 communicates with the recess 7 through the associated through hole 8.

The smoother 9 is accommodated in the recess 7. The smoother 9 is made of the known synthetic resin such as polyethylene oxide or polyvinyl, which is swelled and dampened when soaked in the water. This smoother 9 is formed by an extrusion process and has a uniform circular cross section for its entire length determined according to the size of the recess 7. The smoother 9 accommodated in the recess 7 is directed outward and kept retracted below the upper surface of the cap member 1.

A net body 10 made of stainless is disposed opposing to the inner side of the cap member 1. The net body 10 has a front portion protruding upward from the opening 3 and including three first holes 11. The net body 10 has a rear portion including four second holes 12. The projections 5 and the pins 6 of the cap member 1 are respectively fitted into the first holes 11 and the second holes 12, so that the net body 10 is firmly coupled to the inner surface of the cap member 1. The net body 10 covers and closes the recess 7 for preventing the smoother 9 kept in the recess 7 from removing the same.

The first blade 2*a* is disposed opposing to the cap member 1 via the net 10. Likewise, the second blade 2*b* is disposed opposing to the first blade 2*a* via a spacer 13. The blades 2*a*, 2*b* and the spacer 13 respectively have through holes 14, 15, 16 for receiving the pins 6 of the cap member 1. The pins 6 are inserted into through holes 18 of a blade base 17 and caulked for firmly assembling the cap member 1, net 10, the first blade 2*a*, the spacer 13, the second blade 2*b* and the base 17. An unillustrated handle is detachably attached to the thus constructed unit U for use.

According to this embodiment, the smoother 9 is formed in a cylindrical shape which has no projections on the peripheral surface. Accordingly, the die for extruding the smoother 9 can be manufactured with the low expense. The process for manufacturing the smoother 9 is also simplified.

In this embodiment, the diameter of the smoother 9 is determined by depth of a cavity formed in the die. Accordingly, the die can be designed for obtaining the smoother 9 with the desired diameter which corresponds to the depth of the recess 7 the cap member 1. This can omit the troublesome slicing process the conventional manufacturing process required.

The smoother 9 thus manufactured is attached to the recess 7 of the cap member 1 without any special care. In comparison with the conventional smoother having projections to be aligned with the holes of the cap member, attaching the smoother 9 to the cap member 1 is easily carried out.

The smoother 9 accommodated in the recess 7 does not protrude from the cap member 1. This enables the smoother 9 free from contact with the outside articles when the razor unit is put in the washstand or the like. Accordingly, the smoother is kept safe from being damaged, resulting in the excellent durability and dampening and swelling efficiency.

Although only one embodiment of the present invention has been described herein, it should be apparent to those skilled in the art that the present invention may be embodied in many other specific forms without departing from the spirit or scope of the invention. Specially, the smoother 9 can be formed in a shape of angular cylinder or elliptical cylinder.

What is claimed is:

1. A razor unit having a solid lubricant material which is dampened and swelled, when soaked in water, for reducing the rubbing of the razor unit on a user's skin, said razor unit comprising:

a cap member having an inner surface and an outer surface;

a blade protruding from the cap member;

said cap member having a recess in the inner surface and a notch in the outer surface, said notch communicating with the recess;

said solid lubricant material being accommodated in the recess, said solid material having a smooth surface; and said solid lubricant material being retracted in the inner surface of the cap member, wherein said solid lubricant material has an uppermost portion positioned lower than the outer surface of said cap member when the solid lubricant material is swelled.

2. The razor unit as set forth in claim 1, wherein said solid lubricant material is formed in a shape in conformity with the recess.

3. The razor unit as set forth in claim 2, wherein said solid lubricant material is formed through an extruding process.

4. The razor unit as set forth in claim 1 further comprising a net member firmly attached to the inner surface of the cap member for holding the solid lubricant material within the recess.

5. A razor unit having a solid lubricant material which is dampened and swelled, when soaked in water, for reducing the rubbing of the razor unit on a user's skin, said razor unit comprising:

a cap member having an inner surface and an outer surface;

a blade protruding from the cap member;

said cap member having a recess in the inner surface and a notch in the outer surface, said notch communicating with the recess;

said solid lubricant material accommodated in the recess, said solid lubricant material having a smooth surface;

said solid lubricant material being retracted in the inner surface of the cap member, wherein said solid lubricant material has an uppermost portion positioned lower than the outer surface of said cap member when the solid lubricant material is swelled; and a net member attached to the inner surface of the cap member for holding the solid lubricant material within the recess.

6. The razor unit as set forth in claim 5, wherein said solid lubricant material is formed in a shape in conformity with the recess.

7. The razor unit as set forth in claim 5, wherein said solid lubricant material is formed through an extruding process.

* * * * *